US007938043B2

(12) United States Patent
Hu

(10) Patent No.: US 7,938,043 B2
(45) Date of Patent: May 10, 2011

(54) RATCHET WRENCH WITH PREVENTION OF TOOTH DAMAGE

(76) Inventor: Bobby Hu, Taichung (TW)

( * ) Notice: Subject to any disclaimer, the term of this patent is extended or adjusted under 35 U.S.C. 154(b) by 176 days.

(21) Appl. No.: 12/477,964

(22) Filed: Jun. 4, 2009

(65) Prior Publication Data

US 2010/0170367 A1 Jul. 8, 2010

(30) Foreign Application Priority Data

Jan. 6, 2009 (TW) ..... 98100216

(51) Int. Cl.
*B25B 13/46* (2006.01)

(52) U.S. Cl. ..... 81/63.2; 81/63

(58) Field of Classification Search ..... 81/60, 62–63.2; D8/25

See application file for complete search history.

(56) References Cited

U.S. PATENT DOCUMENTS

| | | | | |
|---|---|---|---|---|
| 5,782,147 | A * | 7/1998 | Chaconas et al. | 81/63.1 |
| 6,959,626 | B1 * | 11/2005 | Shen | 81/63.2 |
| 7,121,170 | B2 * | 10/2006 | Shen | 81/63.2 |
| 7,146,883 | B2 * | 12/2006 | Chen | 81/63.2 |
| 2007/0000357 | A1 * | 1/2007 | Hsieh | 81/63.2 |

* cited by examiner

*Primary Examiner* — David B Thomas
(74) *Attorney, Agent, or Firm* — Alan Kamrath; Kamrath & Associates PA

(57) ABSTRACT

A ratchet wrench includes a drive member and a switch rotatably received in a body. A pawl is movably received in the body and has first and second sides. The second side of the pawl includes a pressing portion having upper and lower sections. The pressing portion further includes two pressing sections. Two positioning units are mounted between the switch and the second side of the pawl. The positioning units press against the upper and lower sections to bias the first side of the pawl to engage with the drive member. The positioning units press against one of the pressing sections corresponding to one of two positions of the switch.

7 Claims, 15 Drawing Sheets

RATCHET WRENCH WITH PREVENTION OF TOOTH DAMAGE

BACKGROUND OF THE INVENTION

The present invention relates to a ratchet wrench and, more particularly, to a ratchet wrench with prevention of damage to teeth of a drive member or a pawl resulting from stress concentration.

FIGS. 1-6 show a conventional reversible ratchet wrench 6 including a drive member 5 and a pawl 4. A pin 2 biased by a spring 3 presses against the pawl 4 to engage the drive member 5. A switch 1 is pivotable between two positions to change a driving direction of the ratchet wrench 6. When tightening a workpiece such as a bolt, a nut, or the like by rotating the ratchet wrench 6 in a direction, the drive member 5 also rotates in the direction. Note that the teeth of the pawl 4 meshes with the grooves of the teeth of the drive member 5. When the ratchet wrench 6 is rotated in a reverse direction, the workpiece and the drive member 5 do not rotate together with the ratchet wrench 6. This is because the force imparted from the teeth of the drive member 5 to the teeth of the pawl 4 is larger than the biasing force of the spring 3. Thus, the pawl 4 moves backward. FIGS. 4 and 5 show a momentary status of the pawl 4 in its backward movement. When the ratchet wrench 6 is further rotated in the reverse direction, the drive member 5 and the pawl 4 are engaged again as shown in FIGS. 2 and 3, for the spring 3 and the pin 2 push the pawl 4 back to its position. The workpiece can be tightened through repeated rotation of the ratchet wrench 6 in the direction and the reverse direction.

However, the engaging relationship between the drive member 5 and the pawl 4 can be adversely affected by oil therebetween. Specifically, when oil exists in upper, intermediate, and lower positions Z1, Z2, and Z3 between the drive member 5 and the pawl 4, the pawl 4 inclines and, thus, can not completely mesh with the drive member 5. Thus, the teeth of the pawl 4 partially engage with the teeth of the drive member 5, and thus, have a smaller engaging area with the teeth of the drive member 5 when the ratchet wrench 6 is rotated in the direction. Stress concentration occurs, leading to damage to the teeth of the drive member 5 or the pawl 4 or even to injury to the user. Stress concentration may also occur when the ratchet wrench 6 has normal tolerances in verticality and parallelism of the compartments, grooves, and holes receiving the drive member 5, the pawl 4, and the switch 1. Although stress concentration can be reduced by high-precision processing, the costs are high and the yield is low.

Thus, a need exists for a ratchet wrench that can prevent damage to the teeth of the drive member or the pawl resulting from stress concentration without high-precision processing.

BRIEF SUMMARY OF THE INVENTION

The present invention solves this need and other problems in the field of easy manufacturing of ratchet wrenches by providing, in a preferred form, a ratchet wrench including a body having a compartment with a peripheral wall. The peripheral wall has a pawl groove in communication with the compartment. The body further includes a switch hole in communication with the pawl groove. A drive member is rotatably received in the compartment of the body about a rotating axis. The drive member includes a plurality of teeth on an outer periphery thereof. The drive member further includes a drive portion adapted to drive a workpiece. A pawl is movably received in the pawl groove. The pawl includes first and second sides. The first side of the pawl includes a plurality of teeth for releasably engaging with the teeth of the drive member. The second side of the pawl includes a pressing portion having upper and lower sections spaced along a pawl axis parallel to and spaced from the rotating axis. The pressing portion further includes first and second pressing sections spaced in a direction perpendicular to the pawl axis. A switch is rotatably received in the switch hole between first and second positions about a pivot axis parallel to and spaced from the rotating axis. A first positioning unit is mounted between the switch and the second side of the pawl. The first positioning unit presses against the upper section of the pressing portion of the pawl to bias the teeth of the pawl to engage with the teeth of the drive member. A second positioning unit is mounted between the switch and the second side of the pawl. The second positioning unit is spaced from the first positioning unit along the pivot axis. The second positioning unit presses against the lower section of the pressing portion of the pawl to bias the teeth of the pawl to engage with the teeth of the drive member.

When the switch is in the first position, the first and second positioning units press against the first pressing section of the pawl, and the first and second positioning units respectively press against the upper and lower sections of the pawl, allowing joint rotation of the body and the drive member in a first direction driving the workpiece and allowing free rotation of the body relative to the drive member in a second direction reverse to the first direction without driving the workpiece.

When the switch is in the second position, the first and the second positioning units press against the second pressing section of the pawl, and the first and second positioning units respectively press against the upper and lower sections of the pawl, allowing joint rotation of the body and the drive member in the second direction driving the workpiece and allowing free rotation of the body relative to the drive member in the first direction without driving the workpiece.

In a preferred form, a third positioning unit is mounted between the switch and the second side of the pawl. The third positioning unit is intermediate and spaced from the first and second positioning units along the pivot axis. The pressing portion of the pawl further includes an intermediate section intermediate the upper and lower sections of the pressing portion along the pawl axis. The third positioning unit presses against the intermediate section of the pressing portion of the pawl to bias the teeth of the pawl to engage with the teeth of the drive member. When the switch is in the first position, the third positioning unit presses against the first pressing section and the intermediate section of the pressing portion of the pawl, allowing joint rotation of the body and the drive member in the first direction driving the workpiece and allowing free rotation of the body relative to the drive member in the second direction without driving the workpiece. When the switch is in the second position, the third positioning unit presses against the second pressing section and the intermediate section of the pressing portion of the pawl, allowing joint rotation of the body and the drive member in the second direction driving the workpiece and allowing free rotation of the body relative to the drive member in the first direction without driving the workpiece.

The present invention will become clearer in light of the following detailed description of illustrative embodiments of this invention described in connection with the drawings.

DESCRIPTION OF THE DRAWINGS

The illustrative embodiments may best be described by reference to the accompanying drawings where.

Figure 1:
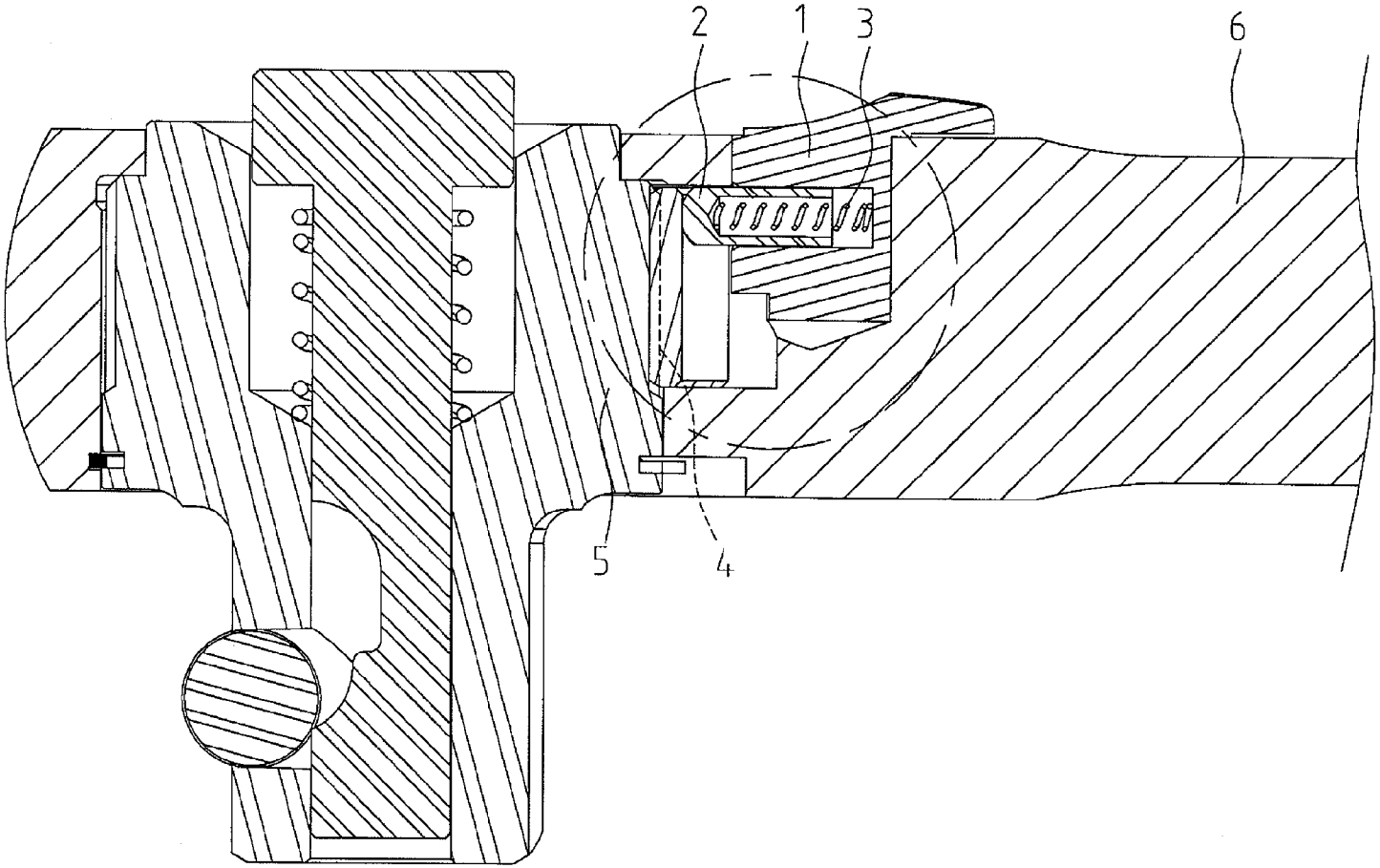
FIG. 1 PRIOR ART
FIG. 1 shows a partial, cross sectional view of a conventional ratchet wrench.
Figure 2:
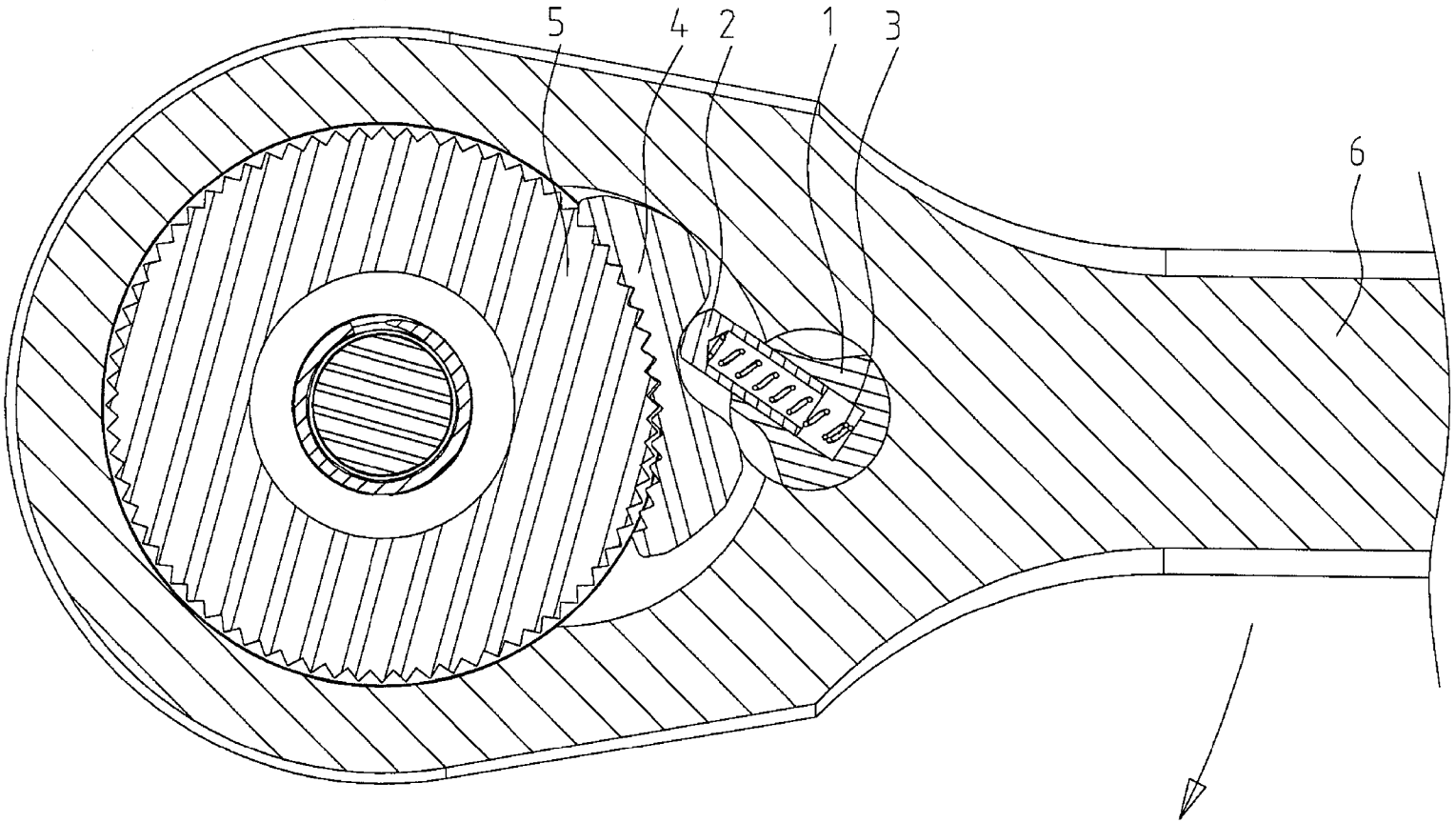
FIG. 2 PRIOR ART
FIG. 2 shows another partial, cross sectional view of the ratchet wrench of FIG. 1.
Figure 3:
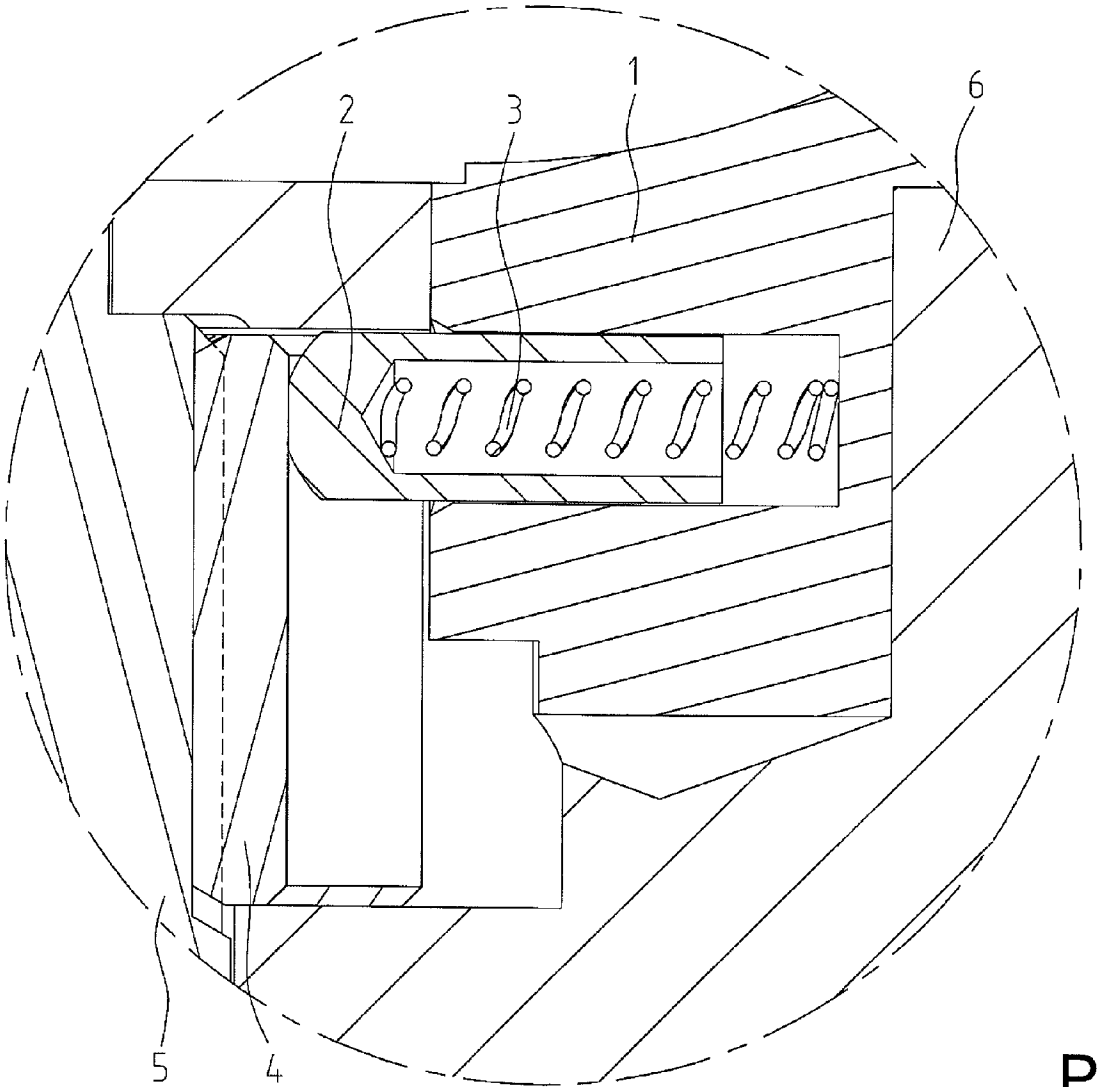
FIG. 3 PRIOR ART
FIG. 3 shows an enlarged view of a circled portion of FIG. 1
Figure 4:
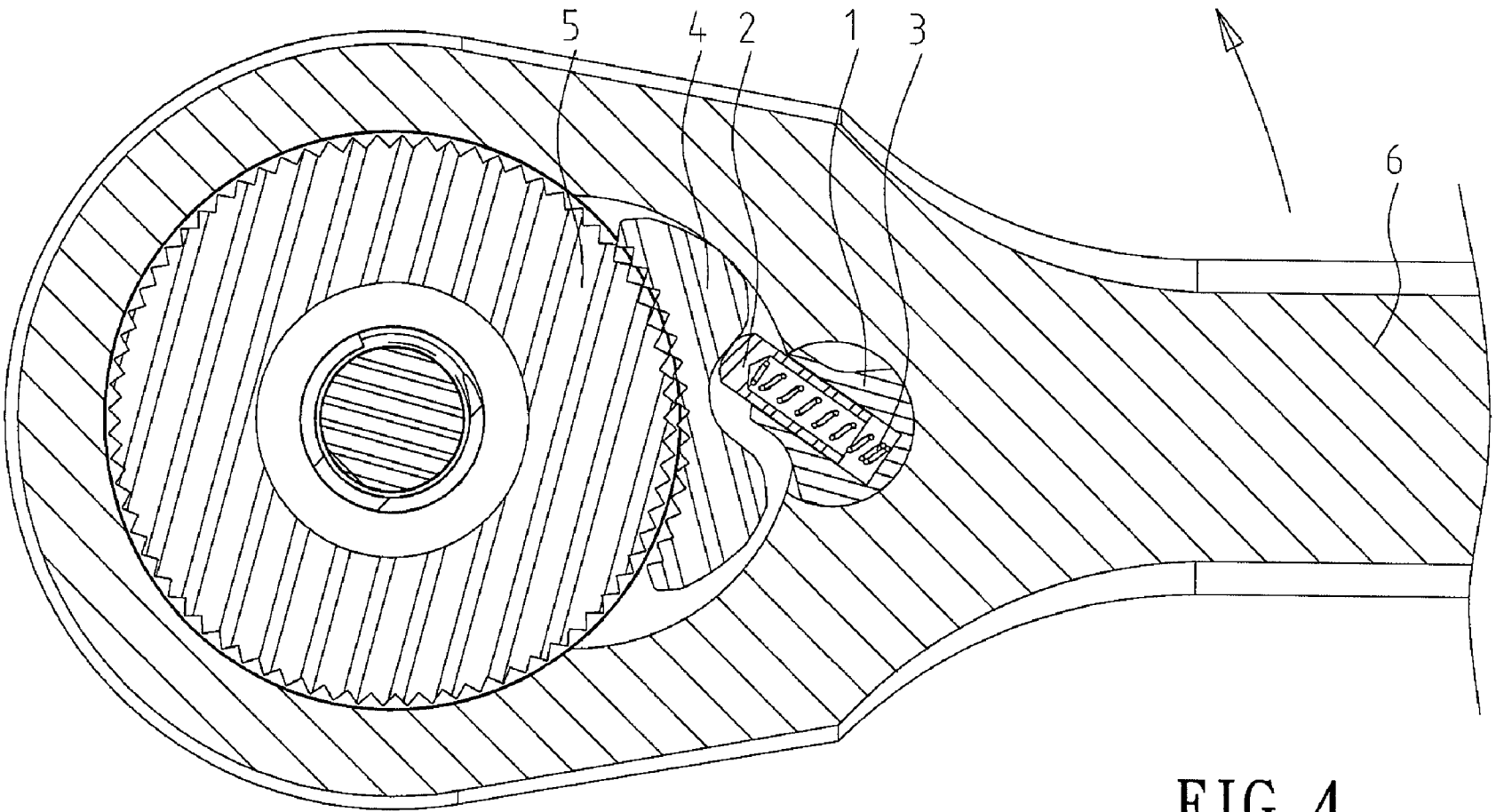
FIG. 4 PRIOR ART
FIG. 4 is a view similar to FIG. 2, illustrating a momentary status of a pawl in its backward movement.
Figure 5:
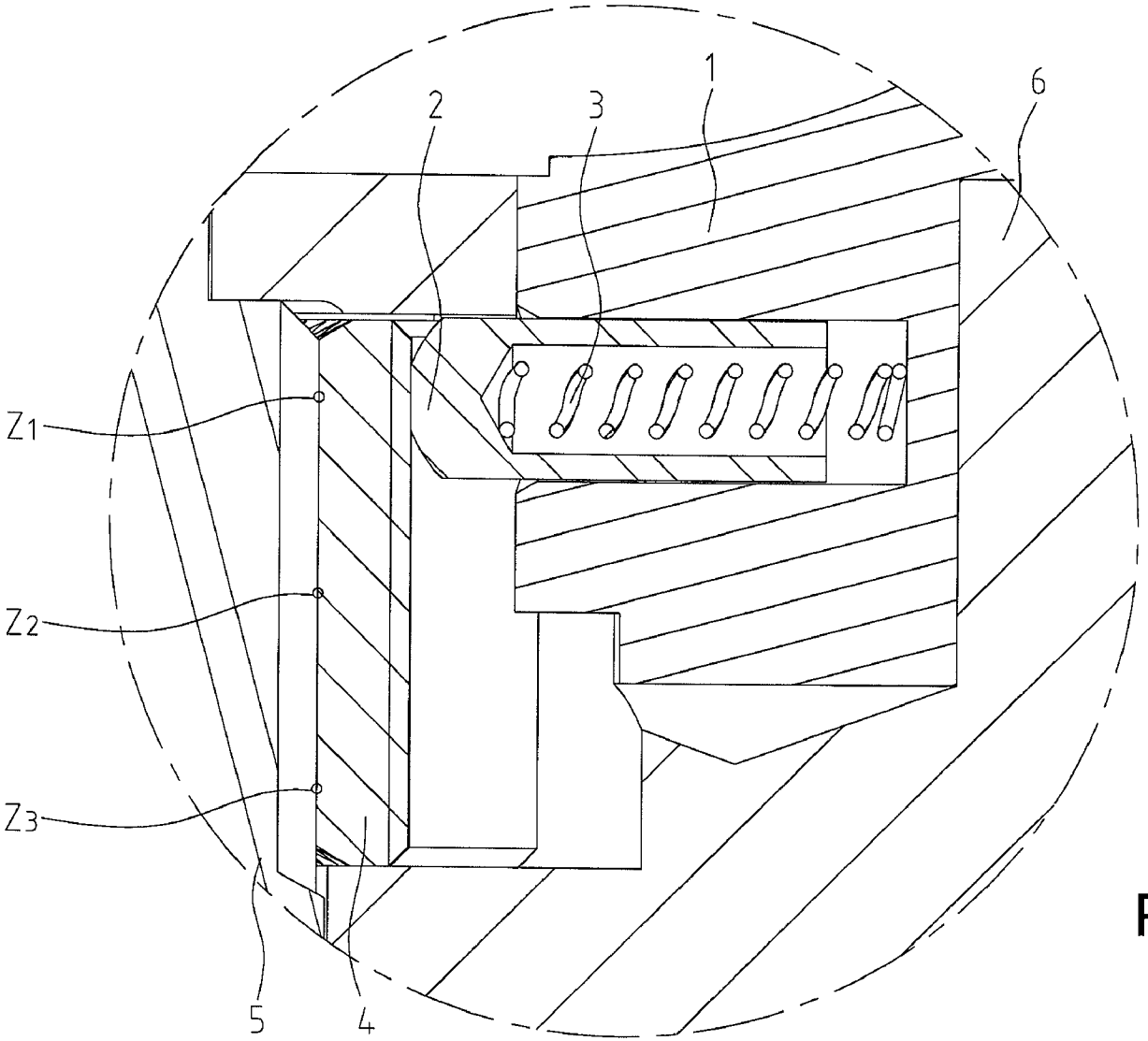
FIG. 5 PRIOR ART
FIG. 5 is a view similar to FIG. 3, illustrating the momentary status of the pawl in its backward movement.
Figure 6:
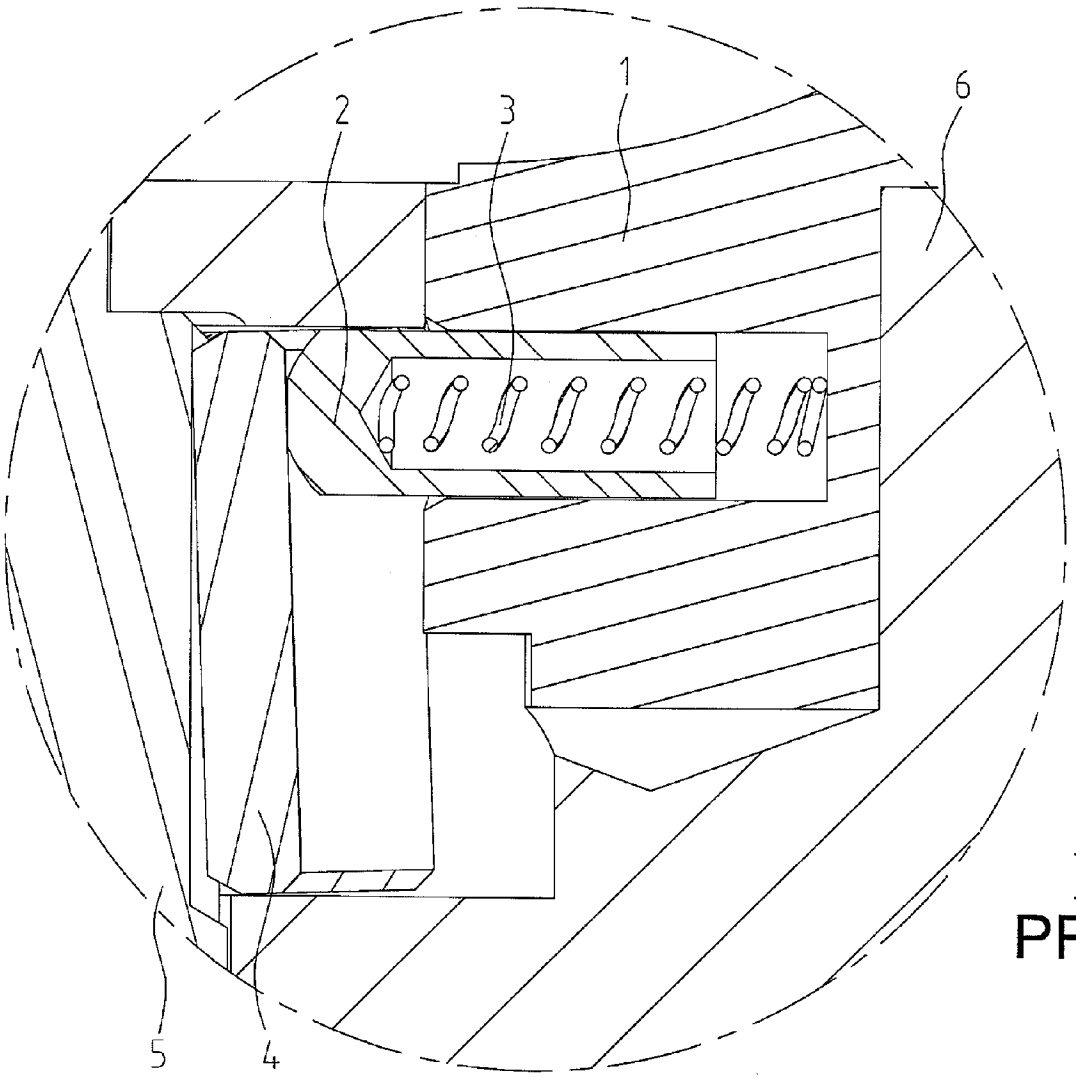
FIG. 6 PRIOR ART
FIG. 6 is a view similar to FIG. 5, illustrating a momentary status of the pawl pressed against by a pin under action of a spring.
Figure 7:
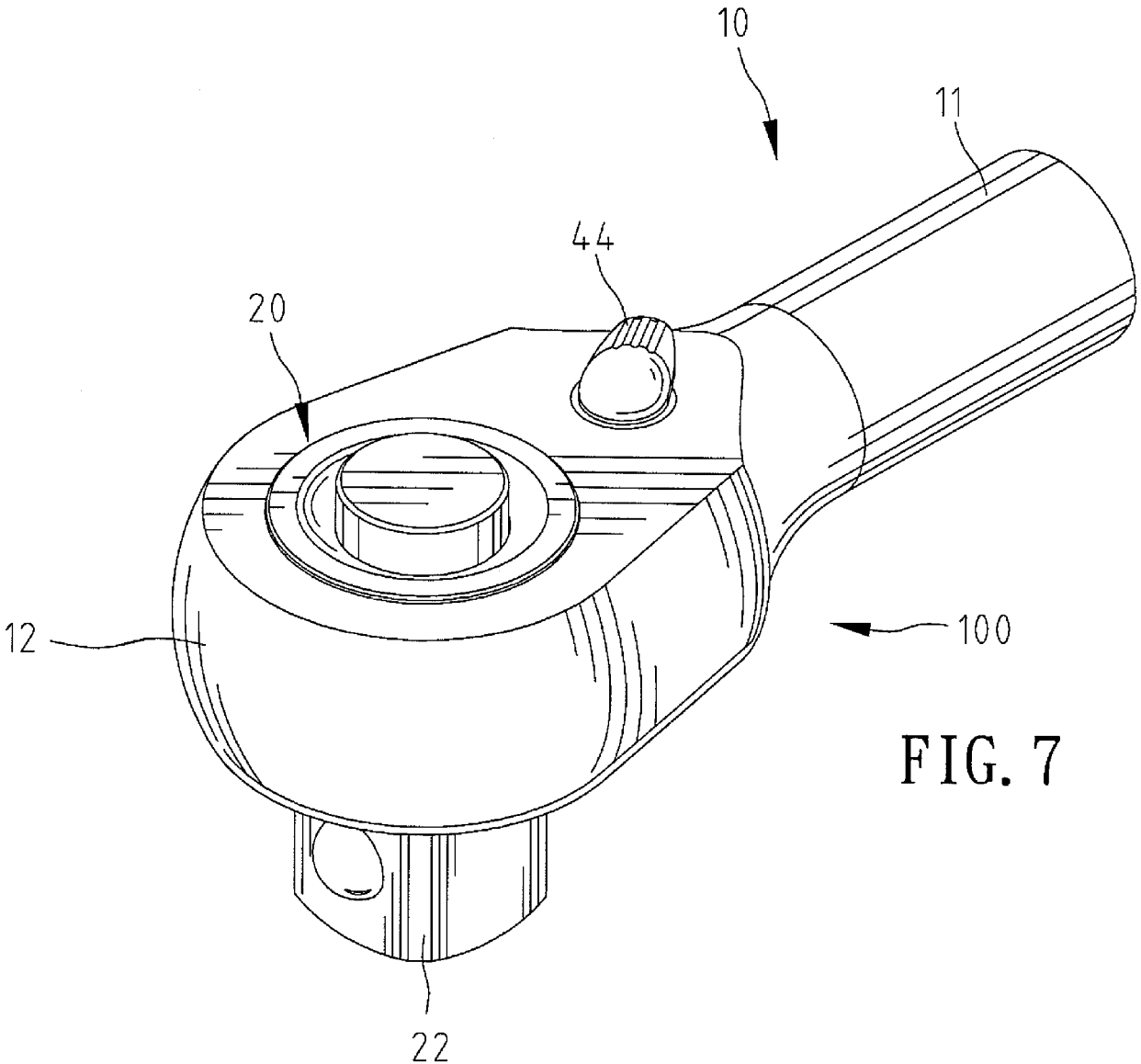
FIG. 7 shows a partial, perspective view of a ratchet wrench of a first embodiment according to the preferred teachings of the present invention.
Figure 8:
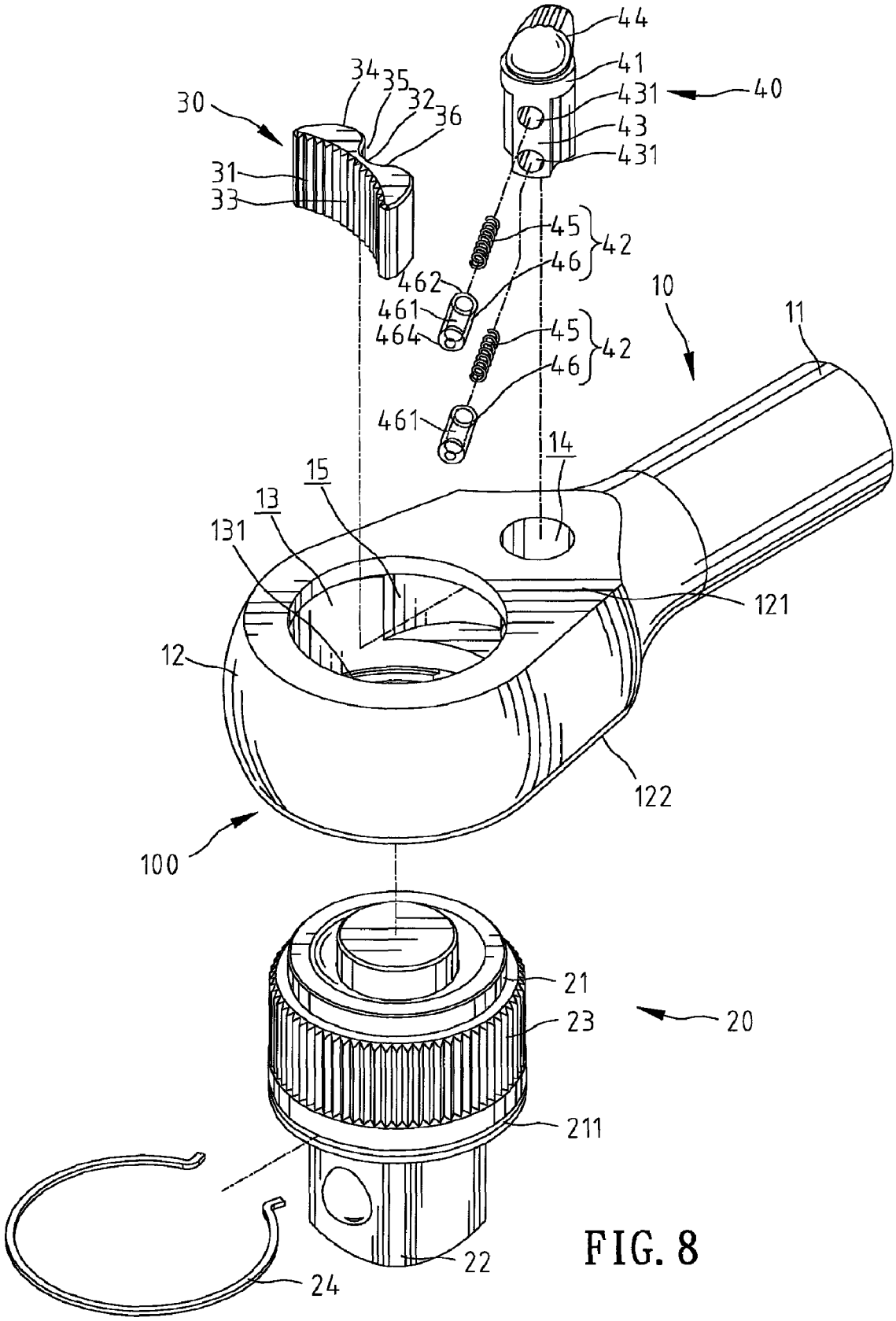
FIG. 8 shows a partial, exploded, perspective view of the ratchet wrench of FIG. 8.
Figure 9:
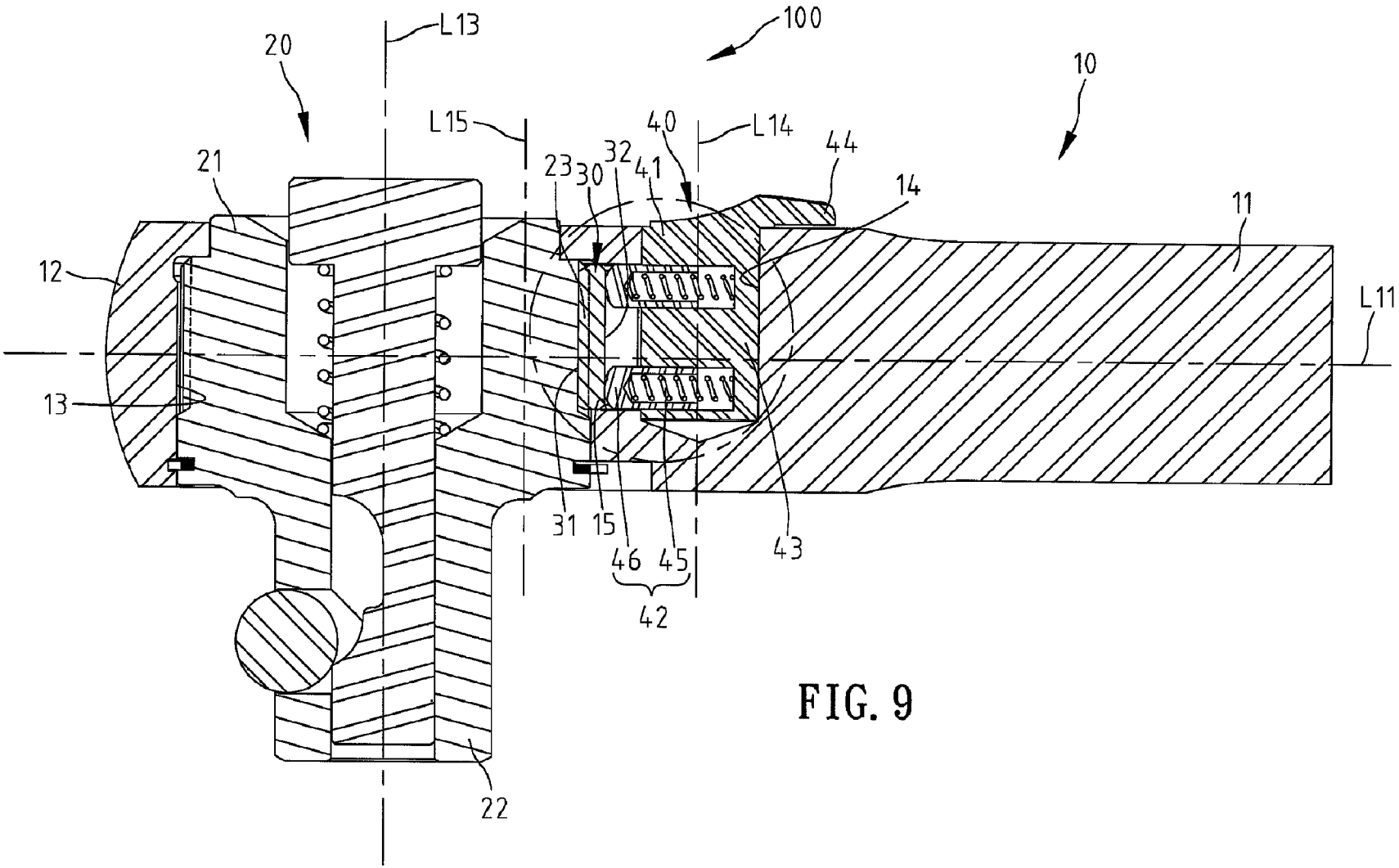
FIG. 9 shows a partial, cross sectional view of the ratchet wrench of FIG. 7.
Figure 10:
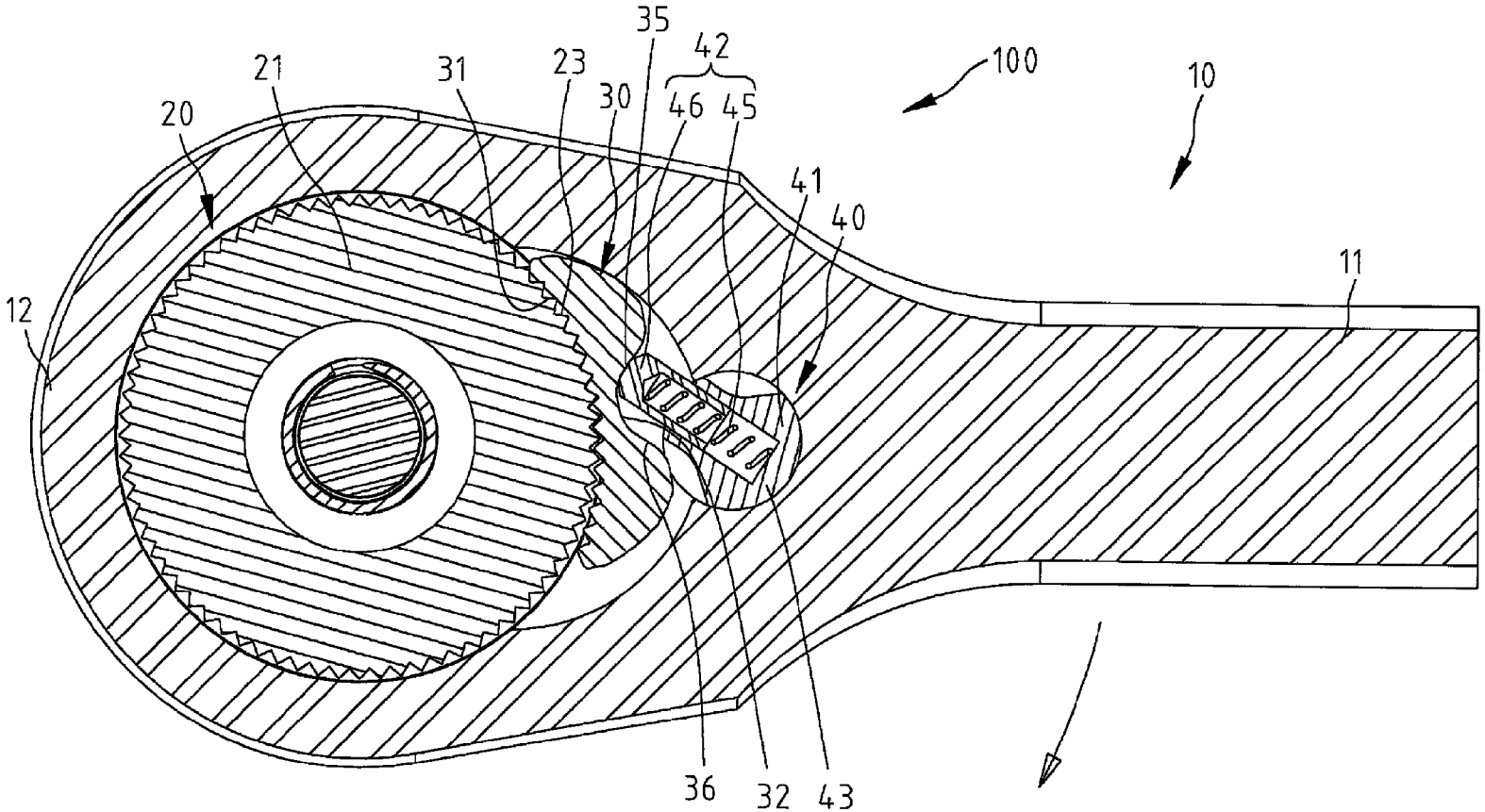
FIG. 10 shows another partial, cross sectional view of the ratchet wrench of FIG. 7.
Figure 11:
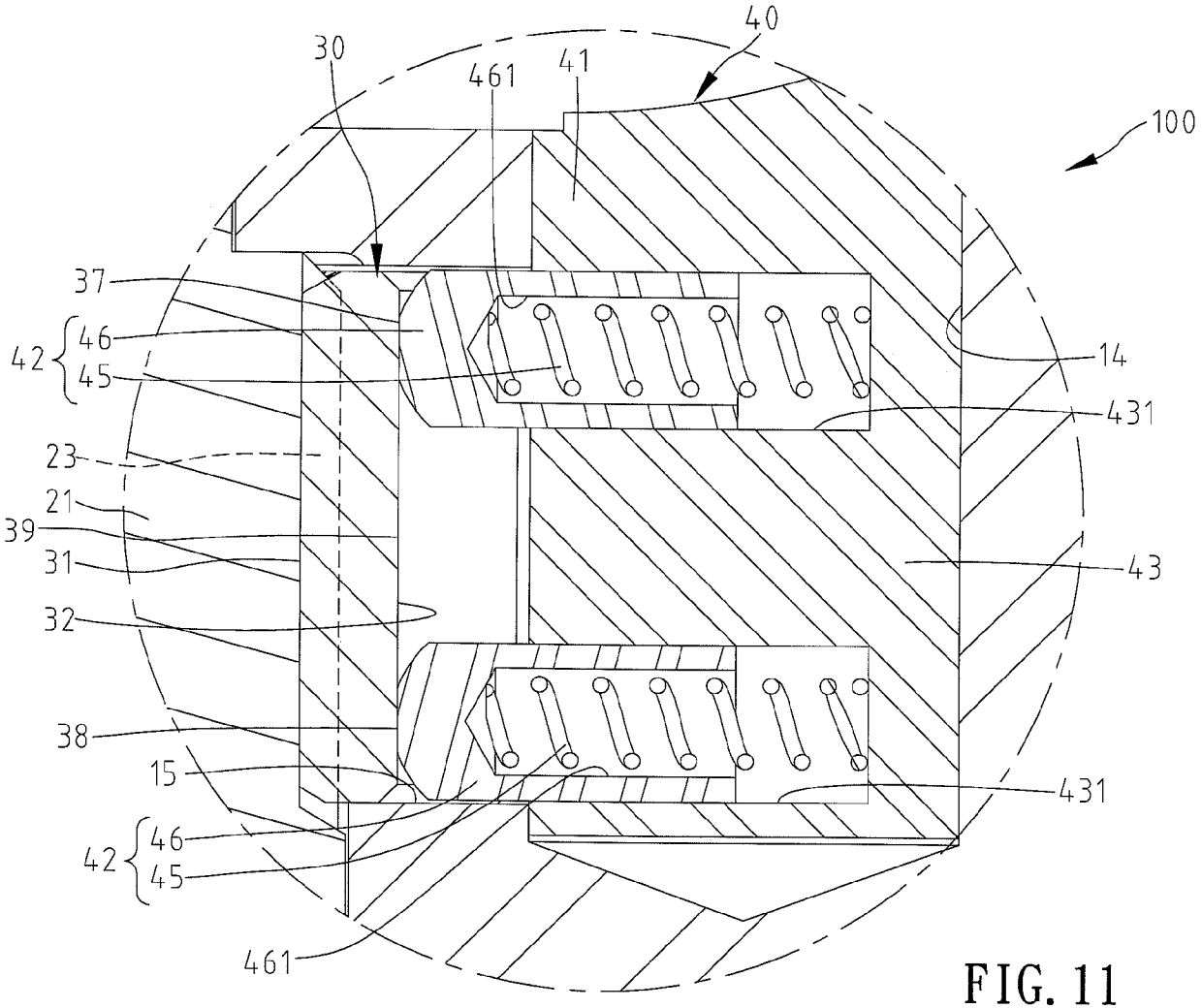
FIG. 11 shows an enlarged view of a circled portion of FIG. 9.
Figure 12:
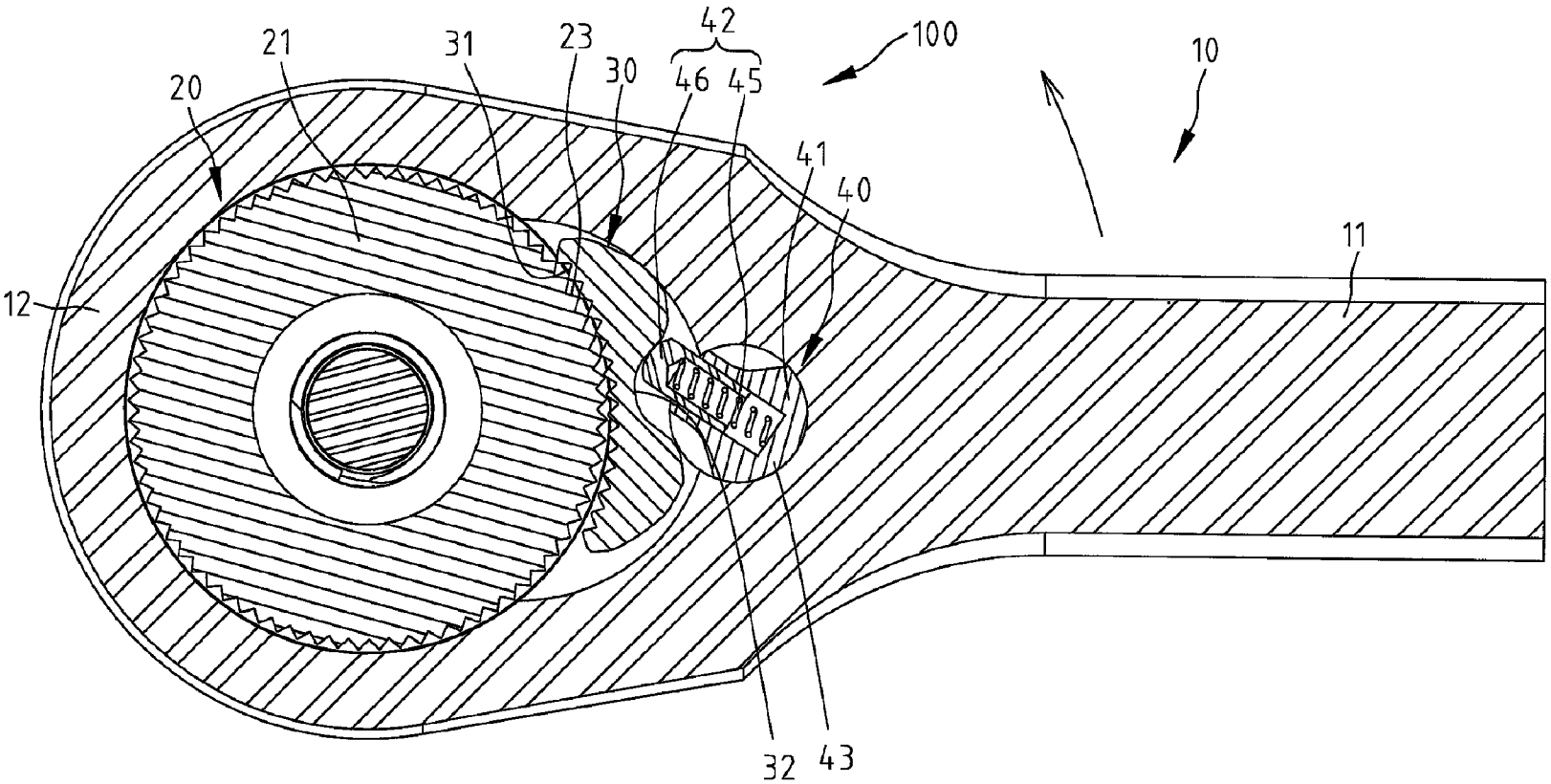
FIG. 12 is a view similar to FIG. 10, illustrating a momentary status of a pawl of the ratchet wrench of FIG. 7.
Figure 13:
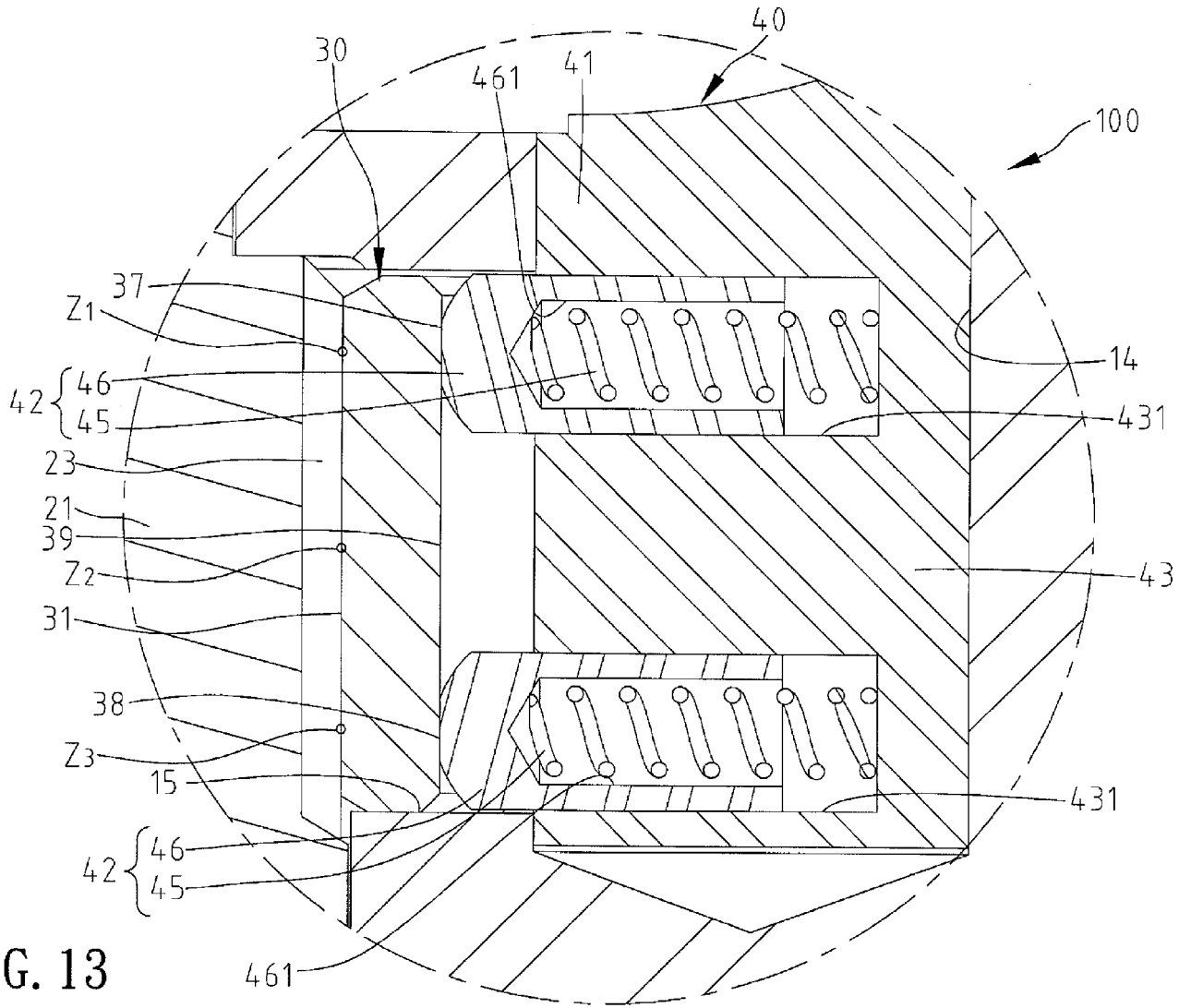
FIG. 13 is a view similar to FIG. 11, illustrating the momentary status of the pawl.

All figures are drawn for ease of explanation of the basic teachings of the present invention only; the extensions of the figures with respect to number, position, relationship, and dimensions of the parts to form the preferred embodiments will be explained or will be within the skill of the art after the following teachings of the present invention have been read and understood. Further, the exact dimensions and dimensional proportions to conform to specific force, weight, strength, and similar requirements will likewise be within the skill of the art after the following teachings of the present invention have been read and understood.

Where used in the various figures of the drawings, the same numerals designate the same or similar parts. Furthermore, when the terms "first", "second", "third", "inner", "outer", "side", "end", "portion", "section", "longitudinal", "clockwise", "counterclockwise", and similar terms are used herein, it should be understood that these terms have reference only to the structure shown in the drawings as it would appear to a person viewing the drawings and are utilized only to facilitate describing the invention.

DETAILED DESCRIPTION OF THE INVENTION

A ratchet wrench according to the preferred teachings of the present invention is shown in the drawings and generally designated 100. In the preferred forms shown in FIGS. 7-15, ratchet wrench 100 includes a body 10 having a handle 11 to be gripped by a user. A head 12 is formed on an end of handle 11 and includes first and second sides 121 and 122 on opposite sides of a longitudinal axis of body 10. Head 12 has a compartment 13 in the preferred forms shown extending from first side 121 through second side 122. A peripheral wall of compartment 13 includes a pawl groove 15 in communication with compartment 13. The peripheral wall of compartment 13 further includes an annular groove 131 adjacent second side 122. Head 12 further includes a switch hole 14 in communication with pawl groove 15 and adjacent handle 11.

In the preferred forms shown in FIGS. 7-15, ratchet wrench 100 further includes a drive member 20 rotatably received in compartment 13 about a rotating axis L13 perpendicular to longitudinal axis L11. Drive member 20 includes a coupling portion 21 having a plurality of teeth 23 on an outer periphery thereof. The outer periphery of coupling portion 21 further includes an annular groove 211. A retainer 24 is received in annular grooves 131 and 211, allowing rotation of drive member 20 in compartment 13 while preventing drive member 20 from disengaging from compartment 13. Other arrangements for rotatably mounting drive member 20 in compartment 13 would be within the skill of the art. Drive member 20 further includes a drive portion 22 adapted to drive a workpiece such as a bolt, nut, etc. In the preferred forms shown in FIGS. 7-14, drive portion 22 is in the form of a drive column for engaging with a socket. In the preferred form shown in FIG. 15, drive portion 22 includes a hole having a polygonal inner periphery for engaging and driving a workpiece.

In the preferred forms shown in FIGS. 7-15, ratchet wrench 100 further includes a pawl 30 movably received in the pawl groove 15. The pawl 30 includes first and second sides 33 and 34. First side 33 of pawl 30 includes a plurality of teeth 31 for releasably engaging with teeth 23 of drive member 20. Second side 34 of pawl 30 includes a pressing portion 32 having upper and lower sections 37 and 38 spaced along a pawl axis L15 parallel to and spaced from rotating axis L13. Pressing portion 32 further includes first and second pressing sections 35 and 36 spaced in a direction perpendicular to pawl axis L15. Pressing portion 32 further includes an intermediate section 39 intermediate upper and lower sections 37 and 38 along pawl axis L15.

In the preferred forms shown in FIGS. 7-15, ratchet wrench 100 further includes a control device 40. Control device 40 includes a switch 41 having a first section 43 rotatably received in the switch hole 14 between first and second positions about a pivot axis L14 parallel to and spaced from the rotating axis L13. Pawl axis L15 is intermediate pivot axis L14 and rotating axis L13 along longitudinal axis L11. Switch 41 further includes a second section 44 outside of switch hole 14 so as to be gripped by a user for rotating switch 41. First section 43 of switch 41 includes first and second receptacles 431 spaced along pivot axis L14 and facing pawl 30. Control device 40 further includes first and second positioning units 42 mounted between switch 41 and second side 34 of pawl 30. Second positioning unit 42 is spaced from first positioning unit 42 along pivot axis L14. First positioning unit 42 includes a first pressing member 46 having a first end 462 received in first receptacle 431 and a second end 464. A first receiving hole 461 extends from first end 462 towards but spaced from second end 464 of first pressing member 46. A first spring 45 is received in the first receiving hole 461 and biases first pressing member 46 so that second end 464 of first pressing member 46 presses against upper section 37 of pressing portion 32 of pawl 30 to bias teeth 31 of pawl 30 to engage with teeth 23 of drive member 20. Second positioning unit 42 includes a second pressing member 46 having a first end 462 received in second receptacle 431 and a second end 464. A second receiving hole 461 extends from first end 462 towards but spaced from second end 464 of second pressing member 46. A second spring 45 is received in second receptacle 431 and biases second pressing member 46 so that second end 464 of second pressing member 46 presses against lower section 38 of pressing portion 32 of pawl 30 to bias teeth 31 of pawl 30 to engage with teeth 23 of drive member 20.

Figure 14:
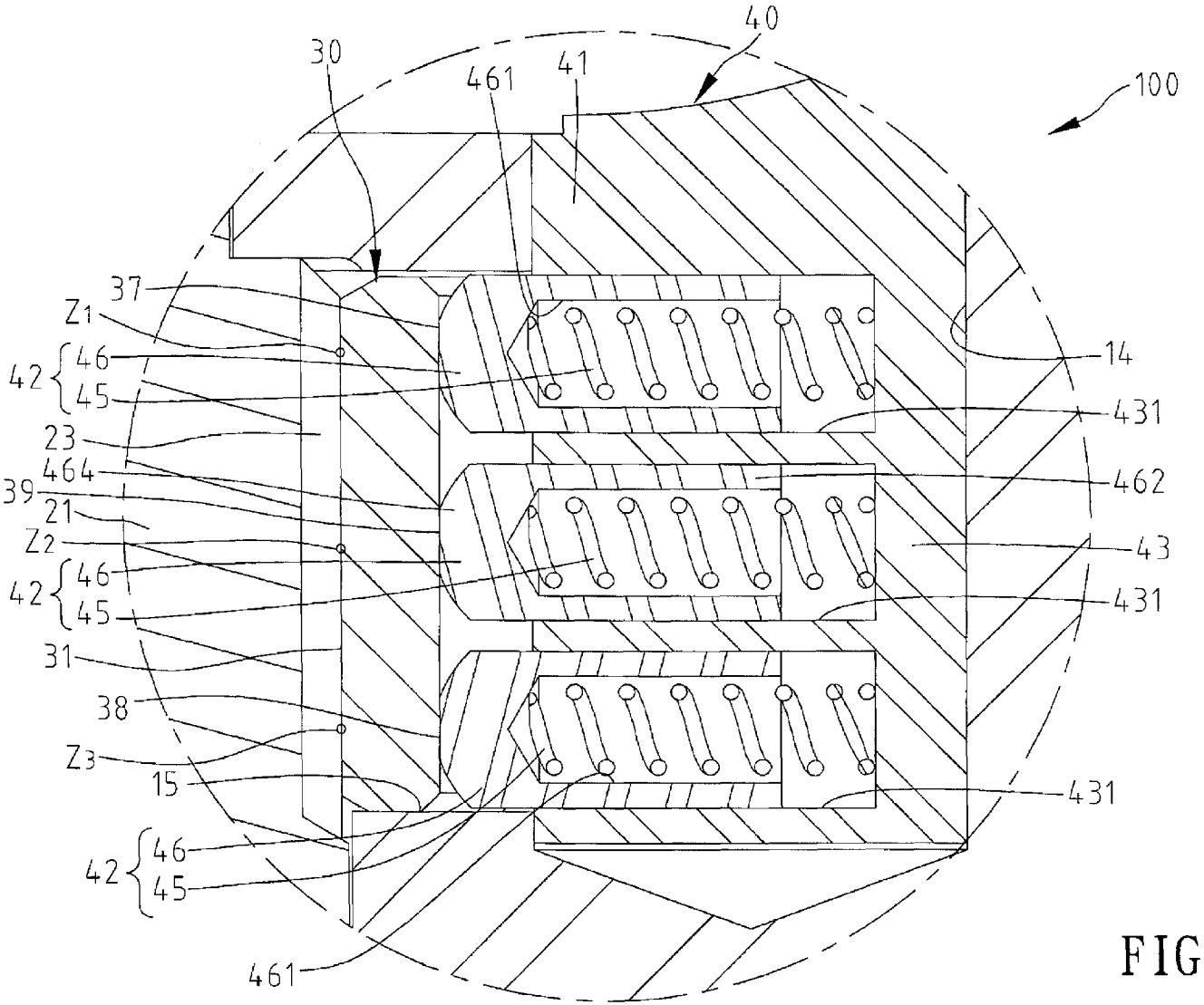
FIG. 14 shows a partial, enlarged, cross sectional view of a ratchet wrench of a second embodiment according to the preferred teachings of the present invention.
Figure 15:
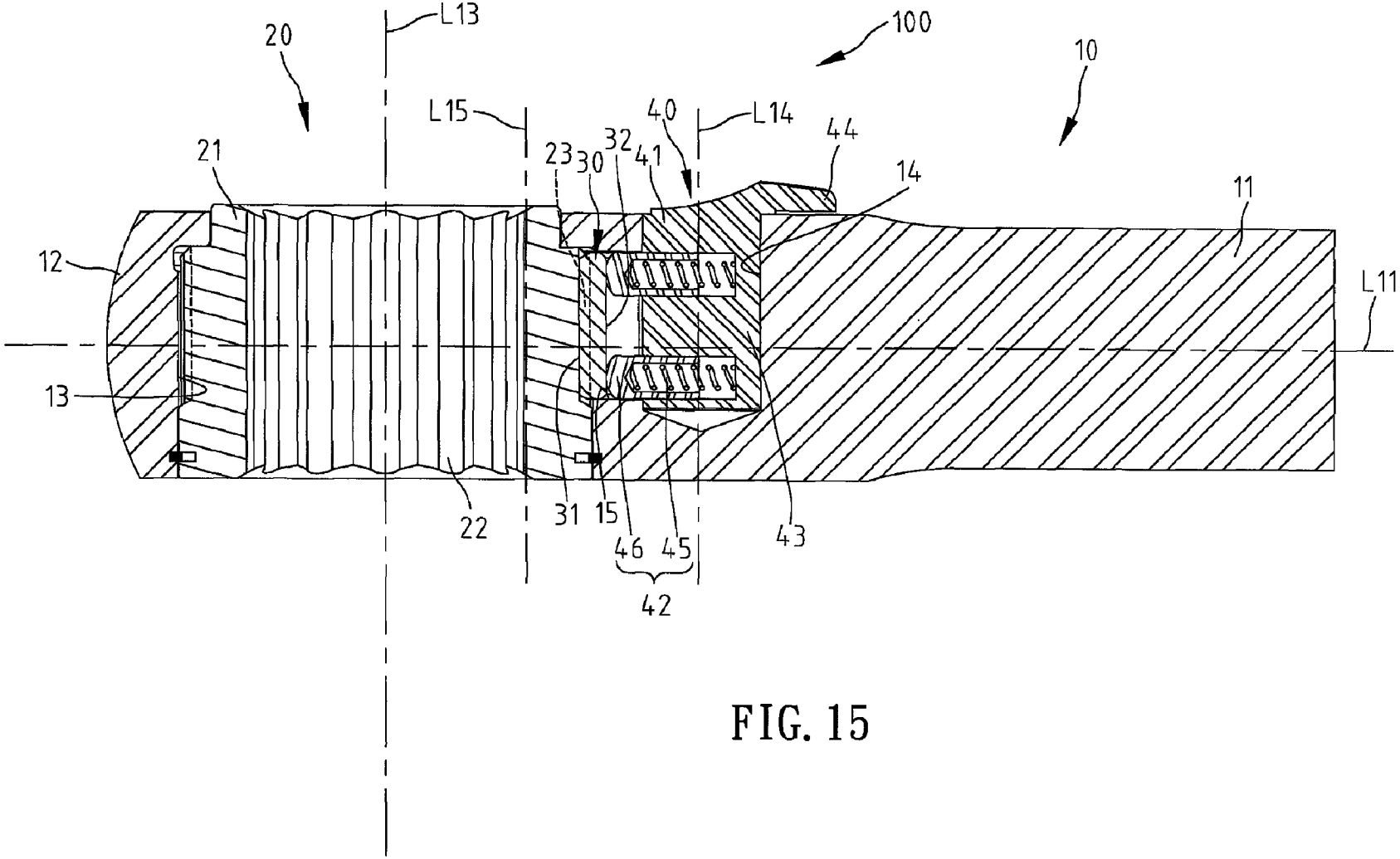
FIG. 15 shows a partial, cross sectional view of a ratchet wrench of a third embodiment according to the preferred teachings of the present invention.

In the preferred form shown in FIG. 14, first section 43 of switch 41 further includes a third receptacle 431 facing pawl 30 and spaced from and intermediate first and second receptacles 431 along pivot axis L14. Control device 40 further includes a third positioning unit 42 spaced from and intermediate first and second positioning units 42 along pivot axis L14. Third positioning unit 42 includes a third pressing member 46 having a first end 462 received in third receptacle 431 and a second end 464. A third receiving hole 461 extends from first end 462 towards but spaced from second end 464 of third pressing member 46. A third spring 45 is received in third receiving hole 461 and biases third presses member 46 so that second end 464 of third pressing member 46 pressing against intermediate section 39 of pressing portion 32 of pawl 30 to bias teeth 31 of pawl 30 to engage with teeth 23 of drive member 20.

Now that the basic construction of ratchet wrench 100 of the preferred teachings of the present invention has been explained, the operation and some of the advantages of ratchet wrench 100 can be set forth and appreciated. When switch 41 is in the first position, first and second positioning units 42 of FIGS. 7-13 and 15 press against first pressing section 35 of pawl 30. Likewise, when switch 41 is in the first position, first, second, and third positioning units 42 of FIG. 14 press against first pressing section 35 of pawl 30. Note that first and second positioning units 42 of FIGS. 7-13 and 15 respectively press against upper and lower sections 37 and 38 of pawl 30 and that first, second, and third positioning units 42 of FIG. 14 respectively press against upper, lower, and intermediate sections 37, 38, and 39 of pawl 30. In this state, body 10 and drive member 20 can rotate jointly in a first direction (the clockwise direction in FIG. 10) driving a workpiece. However, body 10 can rotate freely relative to drive member 20 in a second direction (the counterclockwise direction in FIG. 10) reverse to the first direction without driving the workpiece.

On the other hand, when switch 41 is in the second position, first and second positioning units 42 of FIGS. 7-13 and 15 press against second pressing section 36 of pawl 30. Likewise, when switch 41 is in the second position, first, second, and third positioning units 42 of FIG. 14 press against second pressing section 36 of pawl 30. Note that first and second positioning units 42 of FIGS. 7-13 and 15 respectively press against upper and lower sections 37 and 38 of pawl 30 and that first, second, and third positioning units 42 of FIG. 14 respectively press against upper, lower, and intermediate sections 37, 38, and 39 of pawl 30. In this state, body 10 and drive member 20 can rotate jointly in the second direction driving the workpiece. However, body 10 can rotate freely relative to drive member 20 in the first direction without driving the workpiece.

Provision of two or more positioning units 42 spaced along pivot axis L14 avoids damage to teeth 23 of drive member 20 or teeth 31 of pawl 30 resulting from stress concentration. Specifically, assume oil exists in upper, intermediate, and lower positions Z1, Z2, and Z3 between drive member 20 and pawl 30. Pawl 4 will not incline under the action of positioning units 42. Thus, teeth 31 of pawl 30 completely mesh with grooves of teeth 23 of drive member 20 to provide a larger engaging area with teeth 23 of drive member 20 when ratchet wrench 100 is rotated. Engagement between teeth 31 of pawl 30 and teeth 23 of drive member 20 can be rapidly achieved under that action of positioning units 42, and the engaging effect is reliable. Stress concentration causing damage to teeth 23 of drive 20 or teeth 31 of pawl 30 will not occur.

Table 1 shows tests of service lives of ratchet wrench 100 according to the preferred teachings of the present invention and conventional ratchet wrenches under the condition that pawl 30 is subjected to a pressure of 30 kg/m$^2$ from drive member 20. The safety threshold is 25,000 times. Namely, the ratchet wrench must withstand at least 25,000 times of operation.

TABLE 1

| wrench | pressure | times | safety threshold |
|---|---|---|---|
| conventional | 30 kg/m$^2$ | 3,000-15,000 | 25,000 |
| the present invention | 30 kg/m$^2$ | 35,000 up | 25,000 |

According to the test result, the teeth of the pawl or the drive member of the conventional ratchet wrenches were damaged after having been operated 3,000, 5,000, 8,000, 11,000, or 15,000 times, all of which are smaller than the safety threshold. By contrast, teeth 23 of drive member 20 and teeth 31 of pawl 30 of ratchet wrench 100 according to the preferred teachings of the present invention were not damaged after operation of more than 35,000 times. Thus, ratchet wrench 100 according to the present invention prevents tooth damage and can be manufactured at low costs without high-precision processing.

Now that the basic teachings of the present invention have been explained, many extensions and variations will be obvious to one having ordinary skill in the art. For example, first, second, and third pressing member 46 do not have to include receptacles 461. Furthermore, pressing members 46 can have other forms and shapes according to the teachings of the present invention. As an example, pressing members 46 can be in the form of a ball. Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

The invention claimed is:

1. A ratchet wrench comprising, in combination:

a body including a compartment having a peripheral wall, with the peripheral wall having a pawl groove in communication with the compartment, with the body further including a switch hole in communication with the pawl groove, a drive member rotatably received in the compartment of the body about a rotating axis, with the drive member including a plurality of teeth on an outer periphery thereof, with the drive member further including a drive portion adapted to drive a workpiece;

a pawl movably received in the pawl groove, with the pawl including first and second sides, with the first side of the pawl including a plurality of teeth for releasably engaging with the plurality of teeth of the drive member, with the second side of the pawl including a pressing portion having upper and lower sections spaced along a pawl axis parallel to and spaced from the rotating axis, with the pressing portion further including first and second pressing sections spaced in a direction perpendicular to the pawl axis;

a switch rotatably received in the switch hole between first and second positions about a pivot axis parallel to and spaced from the rotating axis;

a first positioning unit mounted between the switch and the second side of the pawl, with the first positioning unit pressing against the upper section of the pressing portion of the pawl to bias the plurality of teeth of the pawl to engage with the plurality of teeth of the drive member; and a second positioning unit mounted between the switch and the second side of the pawl, with the second positioning unit spaced from the first positioning unit along the pivot axis, with the second positioning unit pressing against the lower section of the pressing portion of the pawl to bias the plurality of teeth of the pawl to engage with the plurality of teeth of the drive member, wherein when the switch is in the first position, the first and second positioning units press against the first pressing section of the pawl, and the first and second positioning units respectively press against the upper and lower sections of the pawl, allowing joint rotation of the body and the drive member in a first direction driving the workpiece and allowing free rotation of the body relative to the drive member in a second direction reverse to the first direction without driving the workpiece, and wherein when the switch is in the second position, the first and the second positioning units press against the second pressing section of the pawl, and the first and second positioning units respectively press against the upper and lower sections of the pawl, allowing joint rotation of the body and the drive member in the second direction driving the workpiece and allowing free rotation of the body relative to the drive member in the first direction without driving the workpiece.

2. The ratchet wrench as claimed in claim 1, with the switch including first and second receptacles spaced along the pivot axis, with the first positioning unit including a first pressing member having a first end received in the first receptacle and a second end, with the first positioning unit further including a first spring received in the first receptacle and biasing the first pressing member so that the second end of the first pressing member presses against the upper section of the pressing portion of the pawl, with the second positioning unit including a second pressing member having a first end received in the second receptacle and a second end, with the second positioning unit further including a second spring received in the second receptacle and biasing the second pressing member so that the second end of the second pressing member presses against the lower section of the pressing portion of the pawl.

3. The ratchet wrench as claimed in claim 2, with the first pressing member including a first receiving hole extending from the first end towards but spaced from the second end of the first pressing member, and with the first spring received in the first receiving hole.

4. The ratchet wrench as claimed in claim 3, with the second pressing member including a second receiving hole extending from the first end towards but spaced from the second end of the second pressing member, and with the second spring received in the second receiving hole.

5. The ratchet wrench as claimed in claim 4, with the switch further including a third receptacle intermediate and spaced from the first and second receptacles along the pivot axis, with the pressing portion of the pawl further including an intermediate section intermediate the upper and lower sections of the pressing portion along the pawl axis, with the ratchet wrench further comprising, in combination: a third pressing member having a first end received in the third receptacle and a second end; and a third spring received in the third receptacle and biasing the third pressing member so that the second end of the third pressing member presses against the intermediate section of the pressing portion of the pawl.

6. The ratchet wrench as claimed in claim 5, with the third pressing member including a third receiving hole extending from the first end towards but spaced from the second end of the third pressing member, with the third spring received in the third receiving hole.

7. The ratchet wrench as claimed in claim 1, further comprising, in combination: a third positioning unit mounted between the switch and the second side of the pawl, with the third positioning unit intermediate and spaced from the first and second positioning units along the pivot axis, with the pressing portion of the pawl further including an intermediate section intermediate the upper and lower sections of the pressing portion along the pawl axis, with the third positioning unit pressing against the intermediate section of the pressing portion of the pawl to bias the plurality of teeth of the pawl to engage with the plurality of teeth of the drive member, wherein when the switch is in the first position, the third positioning unit presses against the first pressing section and the intermediate section of the pressing portion of the pawl, allowing joint rotation of the body and the drive member in the first direction driving the workpiece and allowing free rotation of the body relative to the drive member in the second direction without driving the workpiece, and wherein when the switch is in the second position, the third positioning unit presses against the second pressing section and the intermediate section of the pressing portion of the pawl, allowing joint rotation of the body and the drive member in the second direction driving the workpiece and allowing free rotation of the body relative to the drive member in the first direction without driving the workpiece.

* * * * *